United States Patent [19]

New

[11] Patent Number: 5,066,887

[45] Date of Patent: Nov. 19, 1991

[54] COLOR PICTURE TUBE HAVING AN INLINE ELECTRON GUN WITH AN ASTIGMATIC PREFOCUSING LENS

[75] Inventor: David A. New, Mercerville, N.J.

[73] Assignee: RCA Thomson Licensing Corp., Princeton, N.J.

[21] Appl. No.: 483,487

[22] Filed: Feb. 22, 1990

[51] Int. Cl.[5] ..... H01J 29/50

[52] U.S. Cl. ..... 313/414; 313/412; 313/460

[58] Field of Search ..... 313/412, 414, 460

[56] References Cited

U.S. PATENT DOCUMENTS

| | | | |
|---|---|---|---|
| 4,234,814 | 11/1980 | Chen et al. | 313/412 |
| 4,319,163 | 3/1982 | Chen | 315/14 |
| 4,370,592 | 1/1983 | Hughes et al. | 313/414 |
| 4,388,552 | 6/1983 | Greninger | 313/414 |
| 4,429,252 | 1/1984 | Vieland et al. | 313/414 |
| 4,520,292 | 5/1985 | van Hekken et al. | 313/412 |
| 4,528,476 | 7/1985 | Alig | 313/414 |
| 4,608,515 | 8/1986 | Chen | 313/412 |
| 4,631,058 | 2/1987 | Koshigoe et al. | 313/449 |
| 4,731,563 | 3/1988 | Bloom et al. | 315/382 |
| 4,764,704 | 8/1988 | New et al. | 313/414 |
| 4,877,998 | 10/1989 | Maninger et al. | 315/15 |

OTHER PUBLICATIONS

S. Shirai, M. Fukushima, S. Miyamoto, M. Miyazaki, "Quadrupole Lens For Dynamic Focus And Astigmatism Control In An Elliptical Aperture Lens Gun", SID Digest, (1987), pp. 162–165.

T. Katsuma, E. Hamano, T. Shimaohgi, N. Umezu, "Dynamic Astigmatism Control Quadra Potential Focus Gun For 21-in. Flat Square Color Display Tube", SID Digest, (1988), pp. 136–139.

*Primary Examiner*—Donald J. Yusko
*Assistant Examiner*—Michael Horabik
*Attorney, Agent, or Firm*—Joseph S. Tripoli; Dennis H. Irlbeck; Vincent J. Coughlin, Jr.

[57] ABSTRACT

A color picture tube includes an inline electron gun for generating and directing three inline electron beams along coplanar beam paths toward a screen. The gun includes a plurality of electrodes which form a beam-forming region, a prefocusing lens, and a main focusing lens for the electron beams. The prefocusing lens includes four active surfaces. At least one of the active surfaces has asymmetric prefocusing recesses formed therein.

14 Claims, 8 Drawing Sheets

Fig. 1
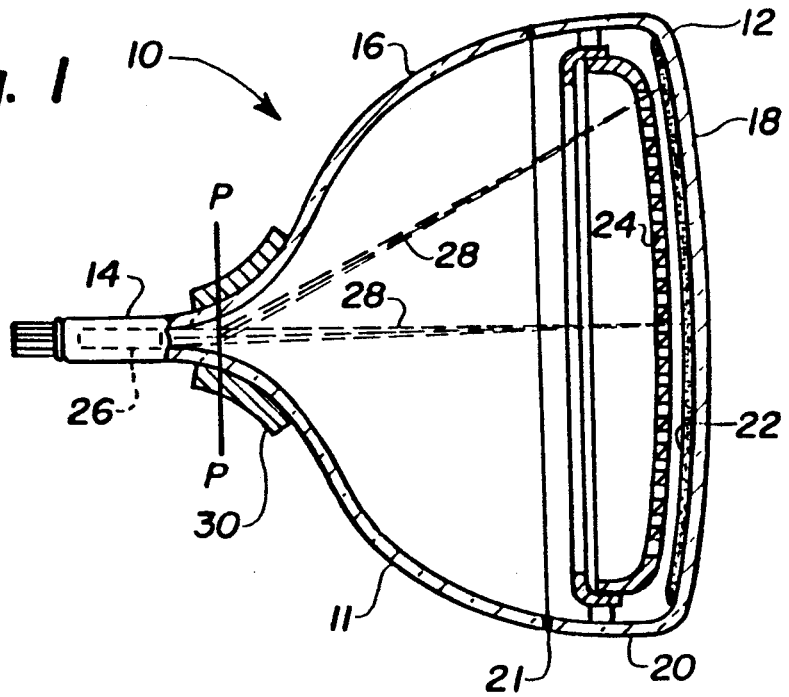
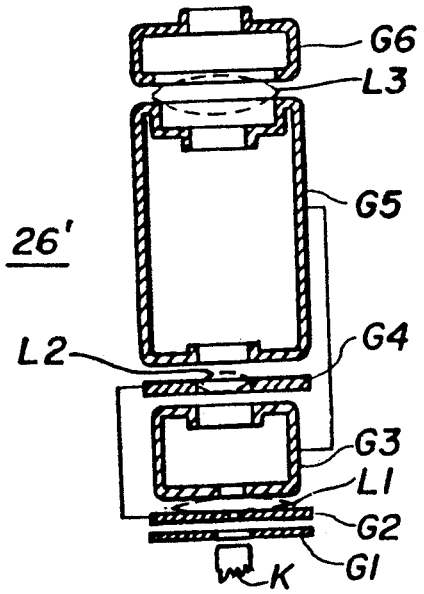
Fig. 2
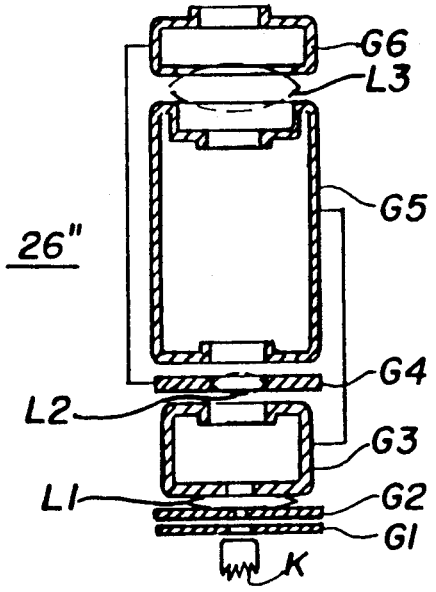
Fig. 3

COLOR PICTURE TUBE HAVING AN INLINE ELECTRON GUN WITH AN ASTIGMATIC PREFOCUSING LENS

The invention relates to a color picture tube having an inline electron gun and, particularly to an electron gun having three lenses including an asymmetric prefocusing lens.

BACKGROUND OF THE INVENTION

An electron gun, such as a six electrode gun, designed for use in a large screen entertainment-type color picture tube must be capable of generating small-sized high-current electron beam spots over the entire screen. A conventional television receiver utilizes a color picture tube with an inline electron gun and a self-converging deflection yoke, for providing a horizontal deflection field having a pincushion-shaped distortion and a vertical deflection field having a barrel-shaped distortion. The fringe fields of such a yoke introduce into the tube strong astigmatism and deflection defocusing caused, primarily, by vertical overfocusing and, secondarily, by horizontal underfocusing of the deflected electron beams. Beam spots formed by the electron beams passing through such distorted horizontal and vertical deflection fields are asymmetrically-shaped when deflected to the periphery of the screen. Additionally, many inline electron guns exhibit a misconvergence of the outer electron beams due to a change in the strength of the electron lens caused by changes in the focus voltage. Such a misconvergence results in a variation in beam landing position with changes in focus voltage. The present invention addresses these problems in an expeditious and cost effective manner without sacrificing performance.

SUMMARY OF THE INVENTION

The present invention provides an improvement in a color picture tube. Such a tube includes an inline electron gun for generating and directing three inline electron beams along coplanar beam paths toward a screen. The gun includes a plurality of electrodes which form a beam-forming region, a prefocusing lens and a main focusing lens for the electron beams. The improvement resides within the prefocusing lens, which includes four active surfaces. At least one of the active surfaces has asymmetric prefocusing means formed therein.

BRIEF DESCRIPTION OF THE DRAWINGS

FIG. 1 is a plan view, partially in axial section, of a shadow mask color picture tube embodying the invention.

FIGS. 2 and 3 are schematic axial section side views of electron guns in which the invention may be employed.

DETAILED DESCRIPTION OF THE PREFERRED EMBODIMENTS

Figure 4:
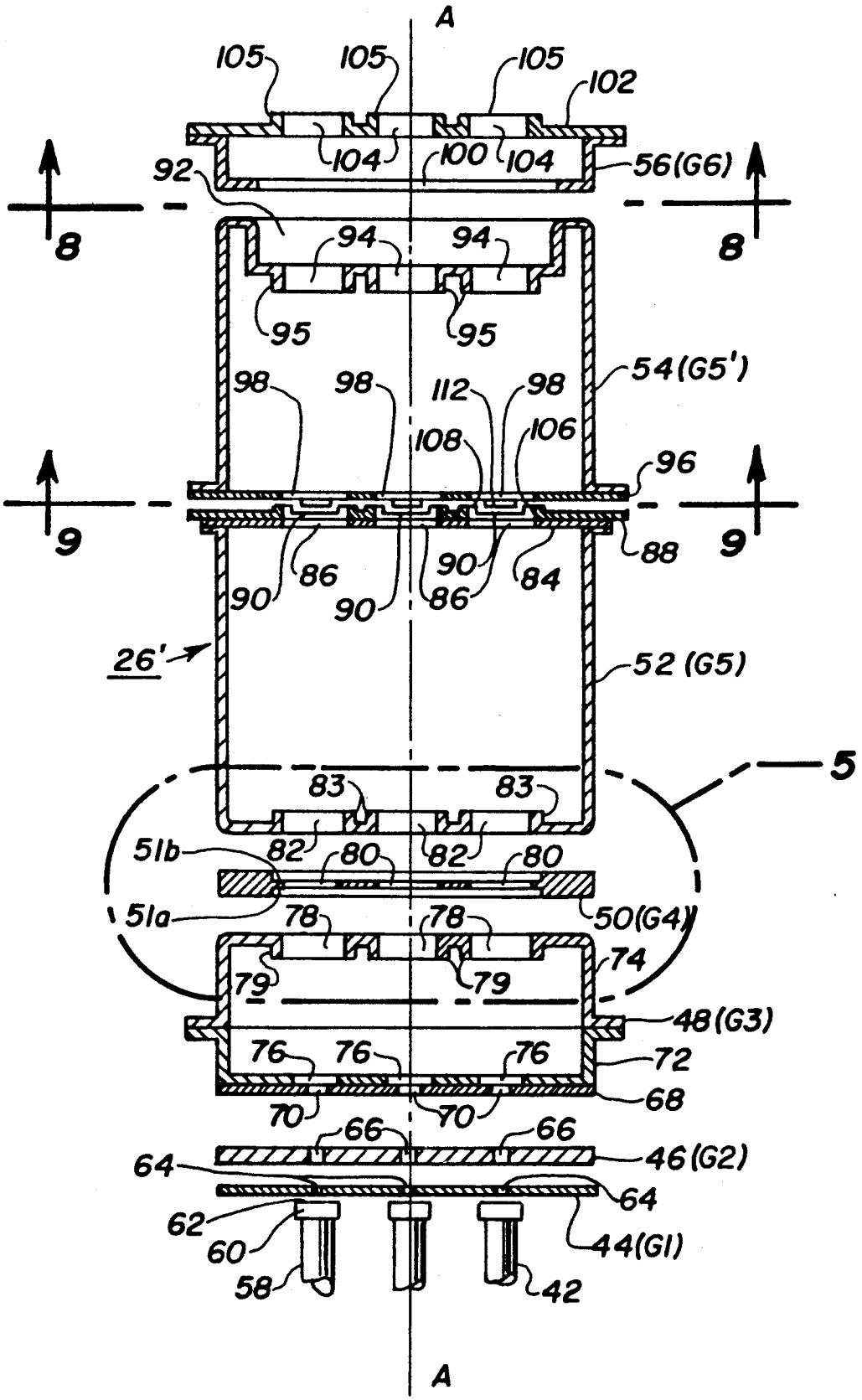
FIG. 4 is an axial section top view of electron gun according to the present invention.

FIG. 1 shows a rectangular color picture tube 10 having a glass envelope 11 comprising a rectangular faceplate panel 12 and a tubular neck 14 connected by a rectangular funnel 16. The panel 12 comprises a viewing faceplate 18 and a peripheral flange or sidewall 20 which is sealed to the funnel 16 with a frit seal 21. A mosaic three-color phosphor screen 22 is located on the inner surface of the faceplate 18. The screen, preferably, is a line screen with the phosphor lines extending substantially perpendicular to the high frequency raster line scan of the tube (normal to the plane of FIG. 1). Alternatively, the screen could be a dot screen. A multiapertured color selection electrode or shadow mask 24 is removably mounted, by conventional means, in predetermined, spaced relation to the screen 22. An improved inline electron gun 26, shown schematically by dashed lines in FIG. 1, is centrally mounted within the neck 14 to generate and direct three electron beams 28, along coplanar convergent beam paths, through the mask 24 to the screen 22.

The tube of FIG. 1 is designed to be used with an external magnetic deflection yoke, such as the yoke 30, located in the neighborhood of the funnel-to-neck junction. When activated, the yoke 30 subjects the three beams 28 to magnetic fields which cause the beams to scan horizontally and vertically, in a rectangular raster, over the screen 22. The initial plane of deflection (at zero deflection) is shown by the line P—P in FIG. 1, at about the middle of the yoke 30. Because of fringe fields, the zone of deflection of the tube extends axially from the yoke 30 into the region of the gun 26. For simplicity, the actual curvature of the deflection beam paths in the deflection zone is not shown in FIG. 1.

The inline electron gun 26 includes six electrodes, G1 through G6, in addition to the cathodes, K. The gun may be of a first type 26', shown in FIG. 2, in which the G2 and G4 electrodes are interconnected and operated at a first potential, and the G3 and G5 electrodes are interconnected and operated at a second potential, or the gun may be of a second type 26'', shown in FIG. 3, in which the G3 and G5 electrodes are interconnected and operated at a third potential, and the G4 and G6 electrodes are interconnected and operated at a fourth potential. In each of the electron guns 26′ and 26″, three electron lenses, $L_1$, $L_2$, and $L_3$, are formed by the aforementioned electrodes. The present invention relates primarily to the second or prefocusing lens, $L_2$.

The details of a first embodiment of the novel electron gun 26′ are shown in FIGS. 4 through 9. With reference to FIG. 4, the gun 26′ comprises three equally spaced coplanar cathodes 42 (one for each beam), a control grid 44 (G1), a screen grid 46 (G2), a third electrode 48 (G3), a fourth electrode 50 (G4), a fifth electrode 52 (G5), the G5 electrode includes a portion G5′ identified as element 54, for a purpose to be described hereinafter, and a sixth electrode 56 (G6). The electrodes are spaced, in the order named, from the cathodes and are attached to a pair of support rods (not shown).

Figure 5:
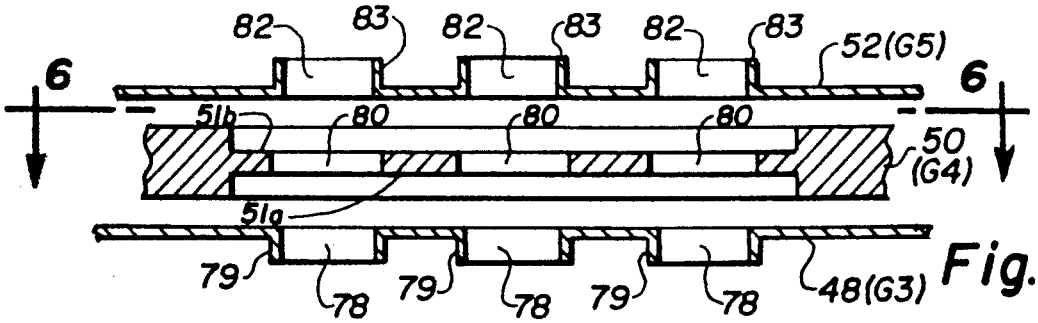
FIG. 5 is a partial section top view of a first embodiment of the prefocusing lens of the present invention.

The G1 electrode 44, the G2 electrode 46 and a first portion 72 of the G3 electrode 48, facing the G2 electrode 46, comprise a beam-forming region of the electron gun 26′ and form the first electron lens, L1. Another portion 74 of the G3 electrode 48, the G4 electrode 50 and the G5 electrode 52 comprise an asymmetric prefocusing or second electron lens, L2, one embodiment of which is shown in FIG. 5. The portion 54 of the G5′ electrode and the G6 electrode 56 comprise a third or main focusing lens L3.

Each cathode 42 comprises a cathode sleeve 58 closed at its forward end by a cap 60 having an end coating 62 of an electron emissive material thereon, as is known in the art. Each cathode 42 is indirectly heated by a heater coil (not shown) positioned within the sleeve 58.

The G1 and G2 electrodes, 44 and 46, are two closely spaced, substantially flat, plates each having three inline apertures, 64 and 66, respectively, therethrough. The apertures 64 and 66 are centered with the cathode coating 62 to initiate three equally-spaced coplanar electron beams 28 (shown in FIG. 1), which are directed towards the screen 22. Preferably, the initial electron beam paths are substantially parallel, with the middle path with the central axis, A—A, of the electron gun.

The G3 electrode 48 includes a substantially flat outer plate portion 68 having three inline apertures 70 therethrough, which are aligned with the apertures 66 and 64 in the G2 and G1 electrodes, 46 and 44, respectively. The G3 electrode 48 also includes a pair of cup-shaped first and second portions, 72 and 74, respectively, which are joined together at their open ends. The first portion 72 has three inline apertures 76, formed through the bottom of the cup, which are aligned with the aperture 70 in the plate 68. The second portion 74 of the G3 electrode has three apertures 78 formed through its bottom, which are aligned with the apertures 76 in the first portion 72. Extrusions 79 surround the apertures 78. Alternatively, the plate portion 68, with its inline apertures 70, may be formed as an internal part of the first portion 72.

As shown in FIG. 5, the G4 electrode 50 comprises a plate having identically-shaped recesses 51*a* and 51*b* formed in the opposed major surfaces thereof. Three inline apertures 80 are formed through the body of the electrode 50, within recesses 51*a* and 51*b*, and aligned with the apertures 78 in the G3 electrode 48.

Again with respect to FIG. 4, the G5 electrode 52 is a deep-drawn, cup-shaped member having three apertures 82, surrounded by extrusions 83, formed in the bottom end thereof. A substantially flat plate member 84, having three apertures 86, aligned with the apertures 82, is attached to and closes the open end of the G5 electrode 52. A first plate portion 88, having a plurality of openings 90 therein, is attached to the opposite surface of the plate member 84.

The G5′ electrode portion 54 comprises a deep-drawn, cup-shaped member having a recess 92 formed in the bottom end thereof, with three inline apertures 94 extending therethrough. Extrusions 95 surround the apertures 94. The opposite open end of the G5′ electrode portion 54 is closed by a second plate portion 96 having three openings 98 formed therethrough. The openings 98 are aligned and cooperate with the openings 90, in the first plate portion 88, in a manner described below.

The G6 electrode 56 is a cup-shaped, deep-drawn member having a large opening 100 at one end through which all three electron beams pass, and an open end which is attached to and closed by a plate member 102 that has three apertures 104 therethrough which are aligned with the apertures 94 in the G5′ electrode portion 54. Extrusions 105 surround the apertures 104.

Figure 6:
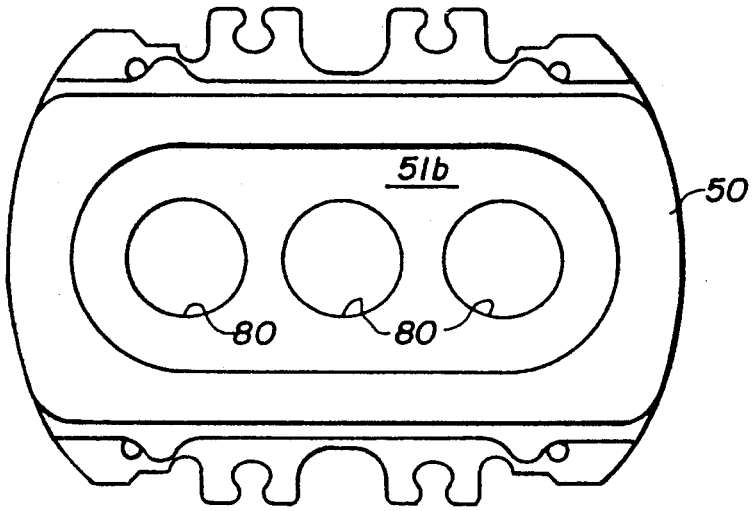
FIG. 6 is a section view of an electrode of the prefocusing lens of FIG. 5, taken along line 6—6.

The shape of the recess 51*b*, formed in the G4 electrode 50, is shown in FIG. 6. The recesses 51*a* and 51*b* have a uniform vertical height at each of the apertures 80 and have rounded ends. Such a shape has been referred to as the "race-track" shape. The recess 92, formed in the bottom end of the G5′ electrode portion 54, is also "race-track-shaped" but differs in dimension from the recesses 51*a* and 51*b* in the G4 electrode 50 as described below.

Figure 8:
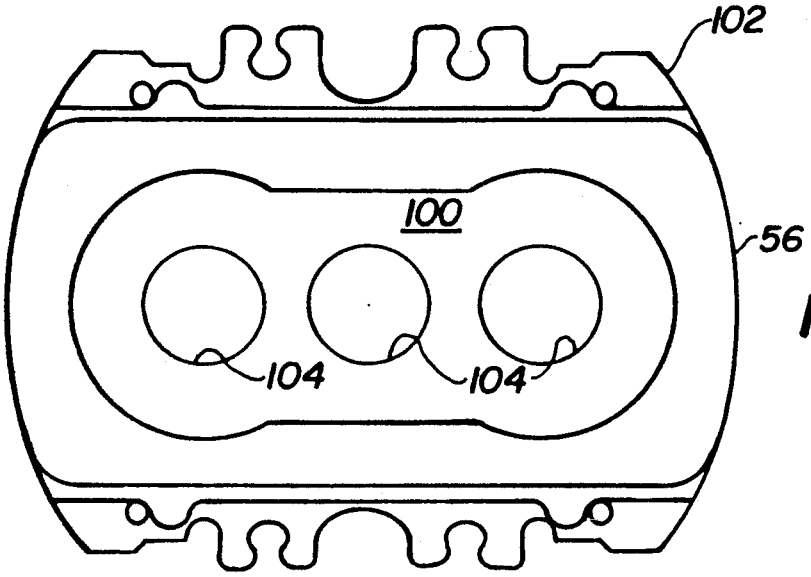
FIGS. 8 and 9 are section views of the electron gun shown in FIG. 4, taken along lines 8—8 and 9—9.

The shape of the large aperture 100 in the G6 electrode 54 is shown in FIG. 8. The opening 100 is vertically higher at the outside apertures 104 than it is at the center aperture. Such a shape has been referred to as the "dog-bone" or "barbell" shape.

Figure 9:
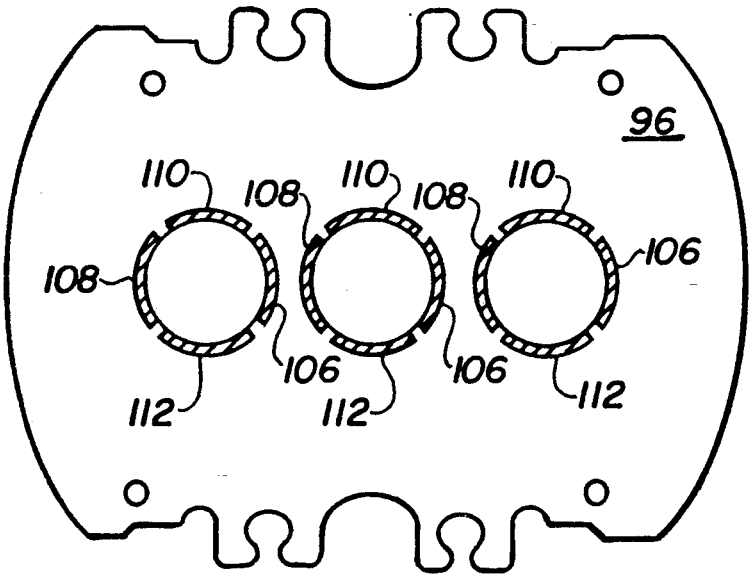

With respect to FIG. 4, the first plate portion 88 of the G5 electrode 52 faces the second plate portion 96 of the G5′ electrode portion 54. The apertures 90 in the first plate portion 88 have extrusions extending from the plate portion that have been divided into two segments, 106 and 108, for each aperture. The apertures 98 in the second plate portion 96 of the G5′ electrode portion 54 also have extrusions extending from the plate portion 96 that have been divided into two segments, 110 and 112, for each aperture. As shown in FIG. 9, the segments 106 and 108 are interleaved with the segments 110 and 112. These segments are used to create quadrupole lenses in the paths of each electron beam when different potentials are applied to the G5 and G5′ electrode and electrode portion, 52 and 54, respectively. By proper application of a dynamic voltage differential to either the G5 electrode 52 or the G5′ electrode portion 54, it is possible to use the quadrupole lenses established by the segments 106, 108, 110 and 112 to provide an astigmatic correction to the electron beams, which compensates for astigmatism occurring in either the electron gun or the deflection yoke. Such a quadrupole lens structure is described in U.S. Pat. No. 4,731,563, to Bloom et al. on Mar. 15, 1988, which is incorporated by reference herein for the purpose of disclosure.

The novel second lens, L2, of the present invention does not require the use of a quadrupole lens formed by the above-described G5 and G5′ electrode and electrode portion, 52 and 54, respectively. A unitized G5 electrode, fabricated by eliminating the first and second plate portions 88 and 96 and attaching together the open ends of elements 52 and 54, may be used; however, such a gun structure would not provide an optimized deflected electron beam shape, although it might be useful where a tradeoff between performance and cost is permissible.

GENERAL CONSIDERATIONS

Specific dimensions of a computer modeled electron gun for the first preferred embodiment are presented in TABLE I.

TABLE I

| | inches | mm |
|---|---|---|
| K-G1 spacing | 0.003 | 0.08 |
| Thickness of G1 electrode 44 | 0.004 | 0.10 |
| Thickness of G2 electrode 46 | 0.028 | 0.71 |
| G1 and G2 aperture diameter | 0.025 | 0.64 |
| G1 to G1 spacing | 0.008 | 0.20 |
| G2 to G3 spacing | 0.030 | 0.76 |
| Thickness of G3 plate portion 68 | 0.010 | 0.25 |
| Diameter of G3 apertures 70 | 0.045 | 1.14 |
| Diameter of G3 apertures 78 | 0.148 | 3.76 |
| Length of G3 electrode 48 | 0.200 | 5.08 |
| G3 to G4 spacing | 0.050 | 1.27 |
| Thickness of active area of G4 electrode 50 | 0.025 | 0.64 |
| Diameter of G4 aperture 80 | 0.158 | 4.01 |
| Horizontal width of recesses 51a and 51b | 0.785 | 19.94 |
| Vertical height of recesses 51a and 51b | 0.239 | 6.07 |
| Depth of recesses 51a and 51b | 0.030 | 0.76 |
| G4 to G5 spacing | 0.050 | 1.27 |
| Overall length of G5 electrode 52 and G5' electrode portion 54 | 0.970 | 24.64 |
| Spacing between plate portions 88 and 96 | 0.040 | 1.02 |
| Horizontal width of recess 92 | 0.755 | 19.18 |
| Vertical height of recess 92 | 0.326 | 8.28 |
| Depth of recess 92 | 0.115 | 2.92 |
| Diameter of apertures 82, 90, 98 | 0.158 | 4.01 |
| Aperture-to-aperture spacing K to G5 bottom | 0.260 | 6.60 |
| Diameter of G5' aperture 94 (center) | 0.160 | 4.06 |
| Diameter of G5' apertures 94 (outer) | 0.180 | 4.57 |
| G5' to G6 spacing | 0.050 | 1.27 |
| Length of G6 electrode 56 | 0.150 | 3.81 |
| Horizontal width of opening 100 | 0.742 | 18.85 |
| Maximum height of opening 100 | 0.295 | 7.49 |
| Minimum height of opening 100 | 0.289 | 7.34 |
| Depth of opening 100 | 0.135 | 3.43 |
| Diameter of G6 aperture 105 (center) | 0.160 | 4.06 |
| Diameter of G6 apertures 105 (outer) | 0.180 | 4.57 |
| Aperture-to-aperture spacing G5'top/G6 | 0.245 | 6.22 |
| Length of G3 extrusions 79 | 0.045 | 1.14 |
| Length of G5 extrusions 83 | 0.045 | 1.14 |
| Length of G5' extrusions 95 | 0.034 | 0.86 |
| Length of G6 extrusions 105 | 0.045 | 1.14 |

In the embodiment presented in TABLE I, the electron gun is electrically connected as shown in FIG. 2. Typically, the cathode operates at about 150V, the G1 electrode at ground potential, the G2 and G4 electrodes are electrically interconnected and operate within the range of about 300V to 1000V, the G3 and G5 electrodes also are electrically interconnected and operate at about 7650V and the G6 electrode operates at an anode potential of about 25 kV.

In the present electron gun 26', the first lens, L1 (FIG. 2), provides a symmetrically-shaped, high quality electron beam into the second lens, L2. The first lens, L1, comprises the beam forming region of the gun and includes the G1 electrode 44, the G2 electrode 46, and the first portion of the G3 electrode 48 adjacent the G2 electrode.

The second lens, L2, is the novel asymmetric prefocusing lens which comprises the G4 electrode 50 and the adjacent portions of the G3 electrode 48 and the G5 electrode 52. In the first embodiment, the identical pair of recesses, 51*a* and 51*b*, are formed in the opposed, major, active surfaces of the G4 electrode 50 (see, e.g., FIGS. 5 and 6). While the recesses are, preferably, race-track-shaped, other shapes, e.g., rectangular, which produce the effect described below, are within the scope of the present invention. The active, facing surfaces of the G3 and G5 electrodes, 48 and 52, respectively, are substantially flat. The combination of the above-described active elements produce quadrupole fields which form the asymmetric or astigmatic prefocusing lens which provides a horizontally-elongated electron beam (not shown) into the third or main focusing lens, L3. By providing the astigmatic focusing correction in the prefocusing lens, L2, beyond the electron beam cross-over point which occurs within the first lens, L1, the effectiveness of each quadrupole field is substantially independent of changes in the beam current. Additionally, the race-track-shaped recesses, 51*a* and 51*b*, provide a preconverging action which eliminates misconvergence of the outer beams at the screen, due to changes in the focus voltage, by providing a compensating change in the strength of the prefocusing lens, L2.

While the invention is described in terms of two recesses, it is possible to achieve the same results by forming only one recess in either surface of the G4 electrode 50. The single recess would have a greater depth than either of the recesses 51*a* or 51*b*, and the lateral dimension, i.e., vertical height and horizontal width, would be less than those of either of the recesses to provide equivalent asymmetric and convergence corrections to the beams. The dimensions of the single recess would depend upon the extent of beam corrections required.

Figure 7:
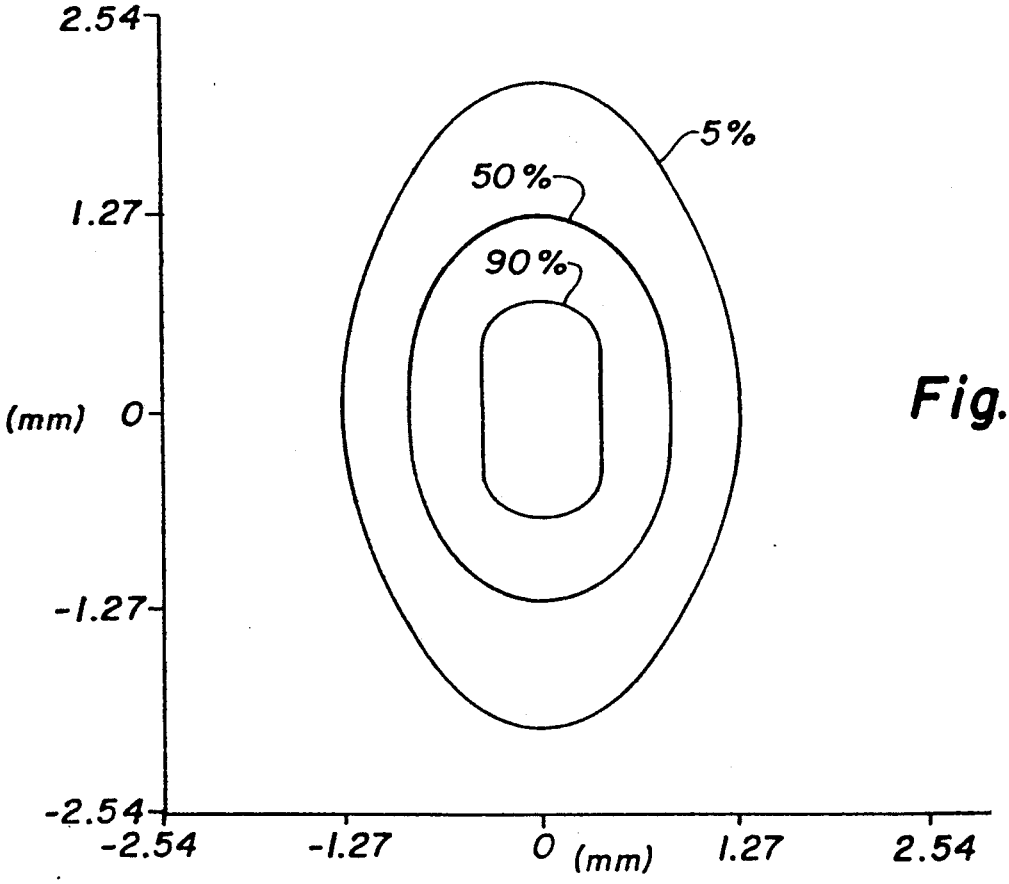
FIG. 7 is a graph of the beam current density contour at the center of the screen for an electron gun utilizing the prefocusing lens electrode of FIG. 5.

The main focusing lens, L3, formed between the G5' electrode portion 54 and the G6 electrode 56, also is an asymmetric lens, having low aberration, which provides a vertically elongated, or asymmetrically-shaped, electron beam spot at the center of the screen. The spacing between adjacent apertures 94 in the G5' electrode portion 54 and the apertures 104 in the G6 electrode 56 is 6.22 mm, rather than the 6.60 mm aperture-to-aperture spacing that exists from the cathodes to the apertures 82 in the bottom G5 electrode 52. This reduced main lens aperture-to-aperture spacing ensures that the preconverged outer beams pass through low-aberration regions of the main lens, L3, to minimize coma distortions. A graph of a computer simulation of the electron beam spot at the center of the screen of a 27 V110° tube, operated at a cathode drive voltage of 103.2 V, a G3/G5 focus voltage of 7650 V, and an ultor voltage of 25 kV and 4 mA beam current, is shown in FIG. 7. The beam spot is elliptically-shaped along the vertical axis to reduce the overfocusing action of the yoke when the beam is deflected. The undeflected, center beam spot includes a substantially rectangularly-shaped 90% peak beam current density portion which is circumscribed by larger elliptically-shaped 50% and 5% peak beam current density portions. The size of the 5% peak beam current density spot is about 2.5 mm×4.2 mm (H×V). With the width of the G4 recesses 51*a* and 51*b* as specified in TABLE I, and the overall length of the gun from the G3 bottom to the top of the G5' electrode portion adjusted to 35.05 mm, the focus voltage is kept below 7700 V, and the misconvergence of the outer beam is reduced to substantially zero.

By utilizing the multipole lens described with respect to FIG. 4, and applying to the G5' electrode portion 54 a dynamic differential focus voltage that ranges from the potential on the G5 electrode 52, with no deflection, to about 1000 volts more positive at maximum deflection, the beam current density spot size can be optimized when the beams are deflected to the periphery of the screen. This mode of operation is discussed in U.S. Pat. No. 4,764,704, issued to New et al. on Aug. 16, 1988, which is incorporated by reference herein for the purpose of disclosure.

Figure 10:
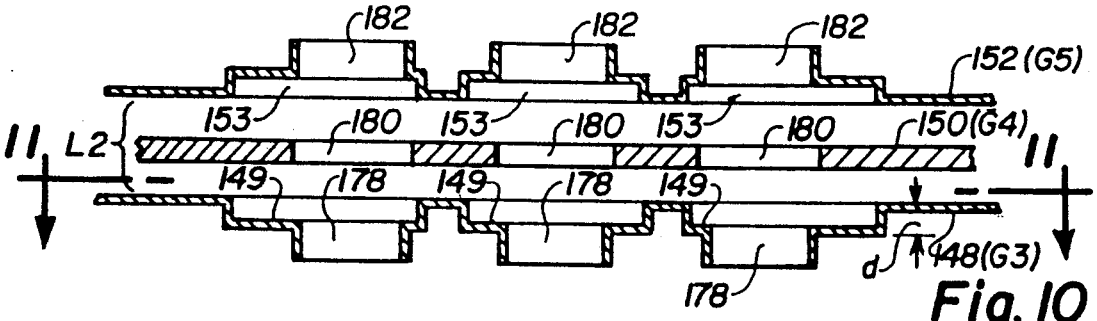
FIG. 10 is a partial section top view of a second embodiment of the prefocusing lens of the present invention.
Figure 11:
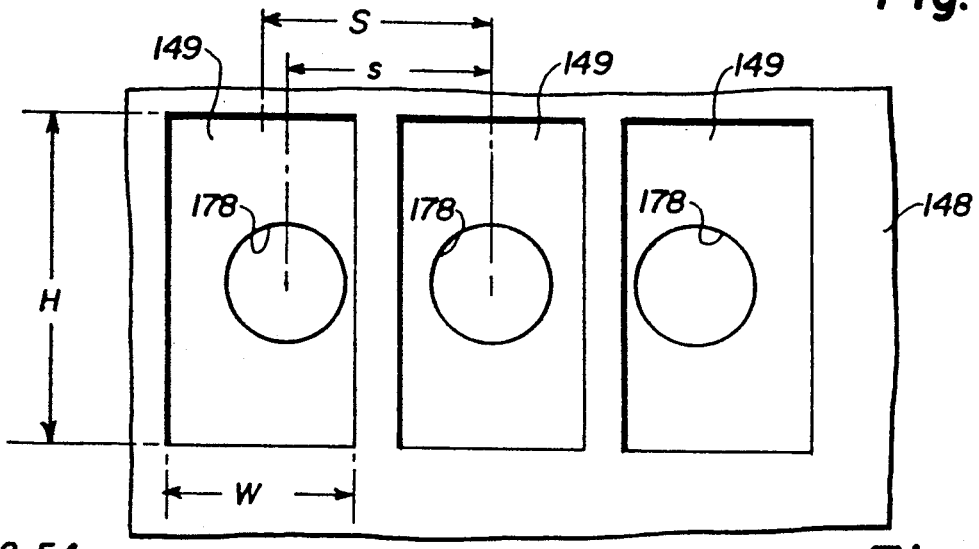
FIG. 11 is a section view of an electrode of the prefocusing lens of FIG. 10, taken along line 11—11.
Figure 12:
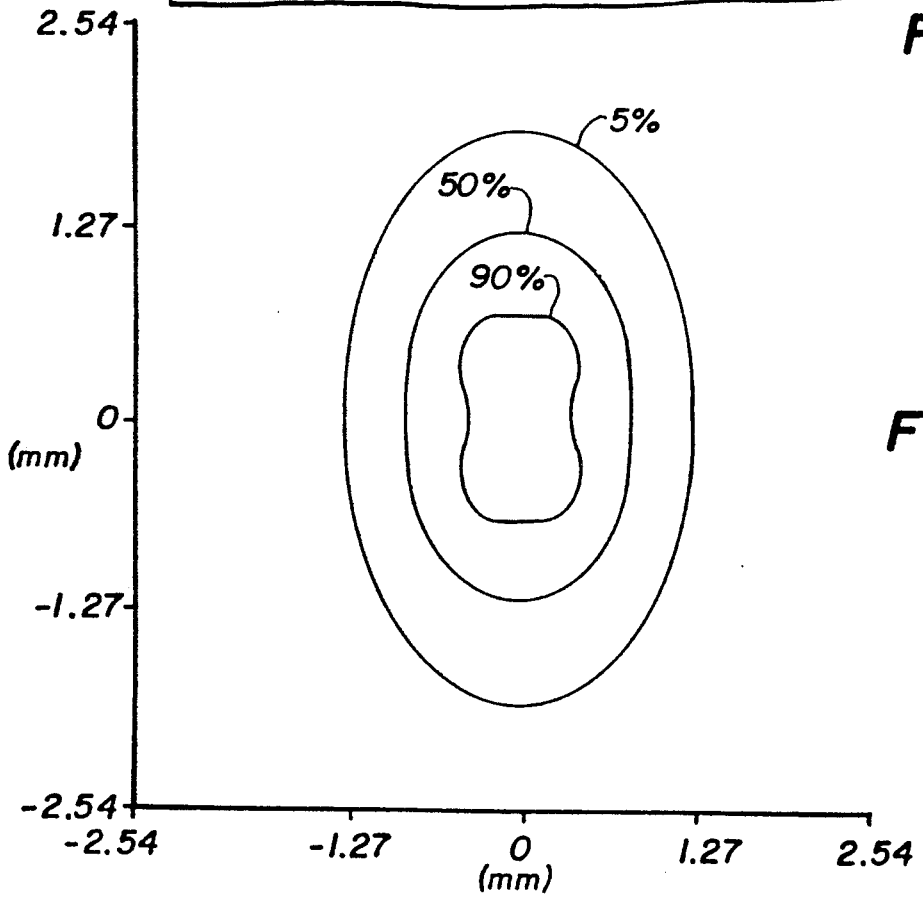
FIG. 12 is a graph of the beam current density contour at the center of the screen for an electron gun utilizing the prefocusing lens of FIG. 10.

A second embodiment of the present invention is obtained by increasing the length of the G3 electrode 148 to 5.84 mm, from the value of 5.08 mm shown in TABLE I, and modifying the asymmetric prefocusing lens, L2, as shown in FIG. 10. In the second embodiment of the lens L2, the G4 electrode 150 comprises a substantially flat plate having a thickness of about 0.025 inch (0.64 mm) with circular apertures 180 formed through the oppositely disposed, active, major surfaces thereof. The active surfaces of the facing G3 and G5 electrodes, 148 and 152, respectively, have rectangular slots enclosing the electron beam apertures. As shown in FIG. 11, each of the slots 149, in the G3 electrode 148, has a slot width, W, of 5.82 mm, and a slot height, H, of 10.16 mm. Each of the slots 149 has a depth, d, of 0.76 mm, shown in FIG. 10. The slot-to-slot spacing, S, shown in FIG. 11, is 7.11 mm. Since the aperture-to-aperture spacing, s, within the prefocusing lens, L2, is 6.60 mm, and the slot-to-slot spacing, S, is 7.11 mm, it can be seen, in FIG. 11, that the two outer slots 149 in the G3 electrode 148 are displaced outwardly relative to the outer apertures 178 formed therein. This displacement of the slots 149 in the G3 electrode, and a similar displacement of the identically dimensional slots 153 in the G5 electrode 152, cooperate to form an asymmetric prefocusing lens, L2, which provides a horizontally-elongated electron beam (not shown) into the third lens, L3. The novel slot configuration in the G3 and G5 electrodes 148 and 152, respectively, also provides a preconverging action to eliminate misconvergence of the outer beams at the screen, in a manner similar to that described for the first embodiment. A computer simulation of the resultant vertically-elongated beam spot at the center of the screen is graphically shown in FIG. 12. When operated at an ultor voltage of 25 kV and 4 mA beam current in a 27 V110° tube, the beam sizes at 90% and 50% peak current density are comparable to those of the first embodiment, shown in FIG. 7, and the beam size at 5% peak current density is about 2.26 mm×3.68 mm (H×V), at a cathode drive voltage of 103.2 V and a G3/G5 focus voltage of 7650 V. All other gun parameters are as listed in TABLE I.

Equivalent performance can be achieved by forming the slots in only one of the active surfaces, i.e., in either the G3 electrode 148 or the G5 electrode 152. Slots formed in only one active surface must be deeper than the slots described above, and the small dimension of each slot must be reduced while the amount of outer slot offset must be increased.

Figure 13:
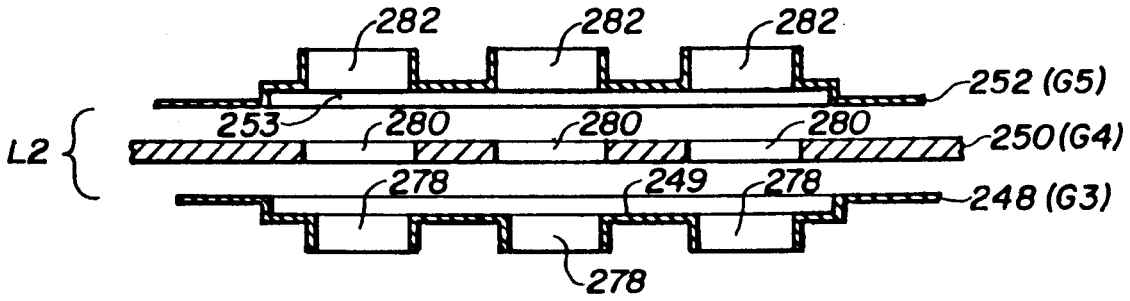
FIG. 13 is a partial section top view of a third embodiment of the prefocusing lens of the present invention.
Figure 14:
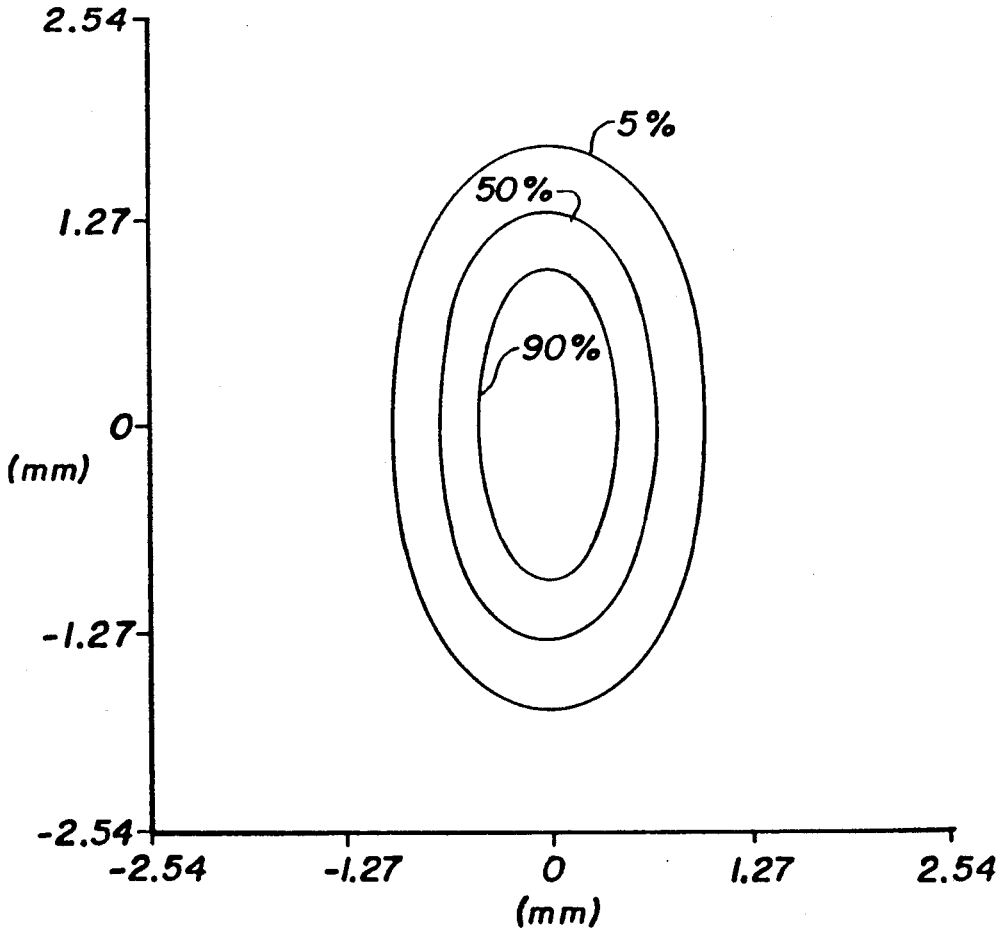
FIG. 14 is a graph of the beam current density contour at the center of the screen for an electron gun utilizing the prefocusing lens of FIG. 13.

A third embodiment of the present invention is achieved by modifying the electron gun to provide the electrical configuration shown in FIG. 3. The asymmetric prefocusing lens, L2, of the gun 26'' is shown in FIG. 13. The length of the G3 electrode 248 is maintained at 5.84 mm, the same dimension utilized in the second embodiment, and a race-track shaped recess 249 is formed in the active, major surface of the G3 electrode facing the G4 electrode 250. The recess 249 has a horizontal width of 19.43 mm, a vertical height of 5.84 mm and a depth of 0.76 mm. An identically-shaped and dimensioned race track recess 253 is formed in the active surface of the G5 electrode 252, facing the substantially flat G4 electrode 250. While the race-track shape is preferred, other geometric shapes which provide an asymmetric lens with a preconvergence correction may be used. In the third embodiment, the G4 electrode 250 has a thickness of about 0.64 mm, with circular apertures 280 formed therethrough. The asymmetric prefocusing lens, L2, of the third embodiment provides the preconverging action, and forms horizontally-elongated electron beams (not shown), as previously described, into the third lens, L3. A computer simulation of the resultant vertically-elongated beam spot at the center of the screen is graphically shown in FIG. 14. When operated at an ultor/G4 voltage of 25 kV and 4 mA beam current in a 27 V110° tube, the beam size and shape at 90% peak beam current density is larger and more elliptical than in the first and second embodiments, while at 50% peak beam current density the elliptically-shaped spot is more vertically elongated than in the first two embodiments. At 5% peak beam current density, the beam spot size is about 1.94 mm×3.44 mm (H×V). The cathode drive voltage in this embodiment is 103.2 V, the G3/G5 focus voltage is 7650 V and the G2 voltage is typically about 400 V. All other gun parameters are as listed in TABLE I.

As described above, a single recess can be formed in either the active surface of the G3 or G5 electrodes, 248 or 252, respectively, if the depth is increased and the lateral dimensions are suitably reduced to provide equivalent performance.

Figure 15:
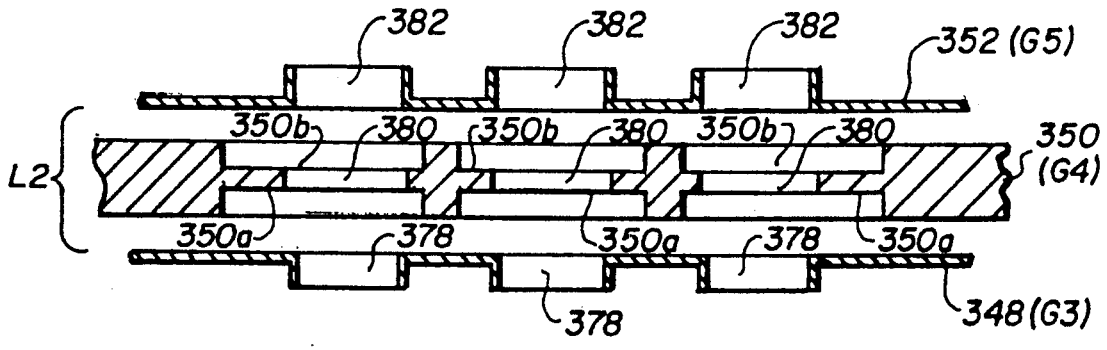
FIG. 15 is a partial section top view of a fourth embodiment of the prefocusing lens of the present invention.

A fourth embodiment of the asymmetric prefocusing lens, L2, is shown in FIG. 15. The length of the G3 electrode 348 is 5.08 mm, and the active surface facing the G4 electrode 350 is substantially flat, with three circular apertures 378 formed therethrough. The apertures 378 have a diameter of 4.01 mm. The G4 electrode 350 has rectangular slots **350*a* and 350*b* formed in the opposed major active surfaces thereof, with the slots 350*a* facing the G3 electrode 348 and the slots 350*b* facing the G5 electrode 352. Each of the slots 350*a* and 350*b* has a width of 5.79 mm, a height of 10.16 mm and a depth of 0.76 mm. The slot-to-slot spacing is 7.01 mm. The circular apertures 380, formed through the G4 electrode 350, have a diameter of 4.01 mm and are enclosed within the rectangular slots 350*a* and 350*b*, in the same manner as discussed with respect to the slots shown in FIG. 11. The active major surface of the G5 electrode 352 facing the G4 electrode 350 also is substantially flat, with three circular apertures 382 formed therethrough. The apertures 382 also have a 80** diameter of 4.01 mm.

Figure 16:
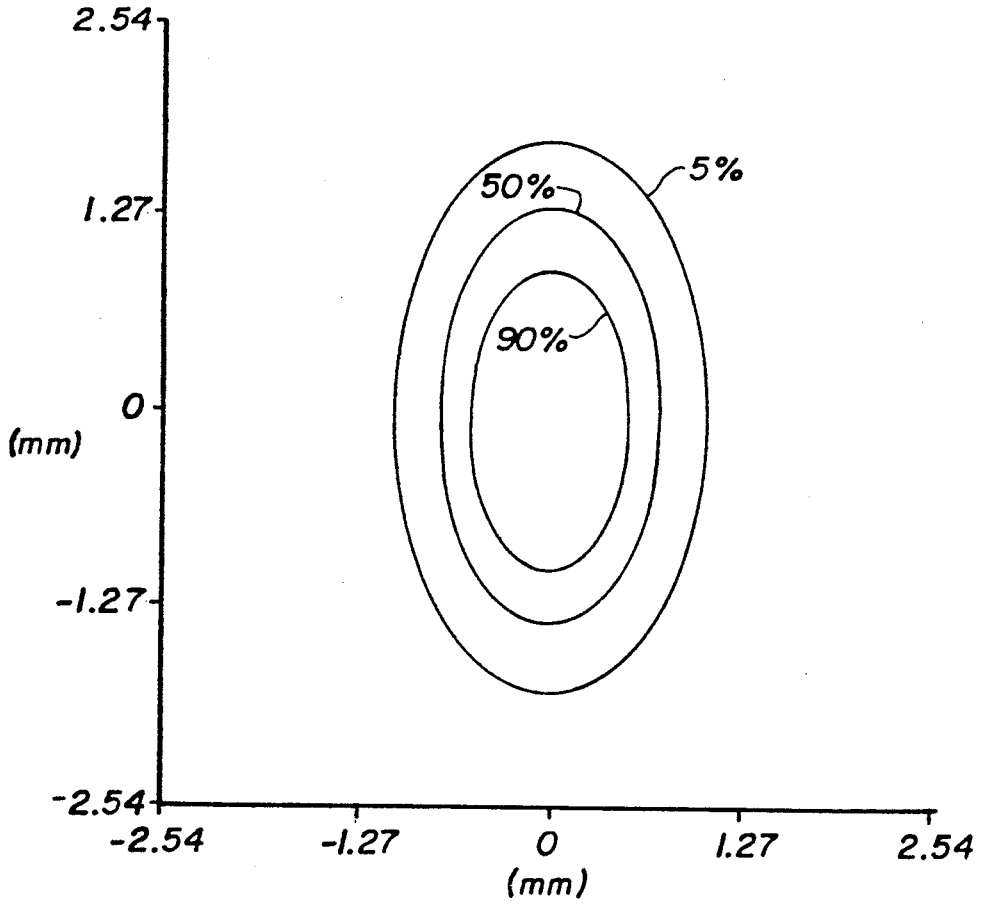
FIG. 16 is a graph of the beam current density contour at the center of the screen for an electron gun utilizing the prefocusing lens of FIG. 15.

Since the aperture-to-aperture spacing within the prefocusing lens, L2, is 6.60 mm and the slot-to-slot spacing of the slots **350*a* and 350*b* of the G4 electrode 350 is 7.01 mm, the two outer slots are displaced outwardly relative to the outer apertures 380 formed within the slots. The configuration and displacement of the G4 slots form an asymmetric lens which provides the preconverging action and horizontally-elongated electron beams (not shown), as previously described, into the third lens, L3. A computer simulation of the resultant vertically-elongated beam spot at the center of the screen is graphically shown in FIG. 16. The beam spot shape is similar to that shown in FIG. 14**. When operated at an ultor/G4 voltage of 25 kV and 4 mA beam current in a 27 V110° tube, the beam size at 5% peak beam current density is about 1.96 mm×3.49 mm (H×V), at a cathode drive voltage of 103.2 V and a G3/G5 focus voltage of 7700 V. The G2 voltage in this embodiment is typically about 400 V. All other gun parameters are as listed in TABLE I.

Alternatively, slots can be formed in only one of the active surfaces of the G4 electrode 350. The depth of the slots must be increased, and the small dimension of each slot must be decreased, from the respective dimensions described immediately above. Additionally, the amount of offset of the outer slots must be increased to obtain performance equivalent to that of the fourth embodiment.

GENERAL CONSIDERATIONS

Figure 17:
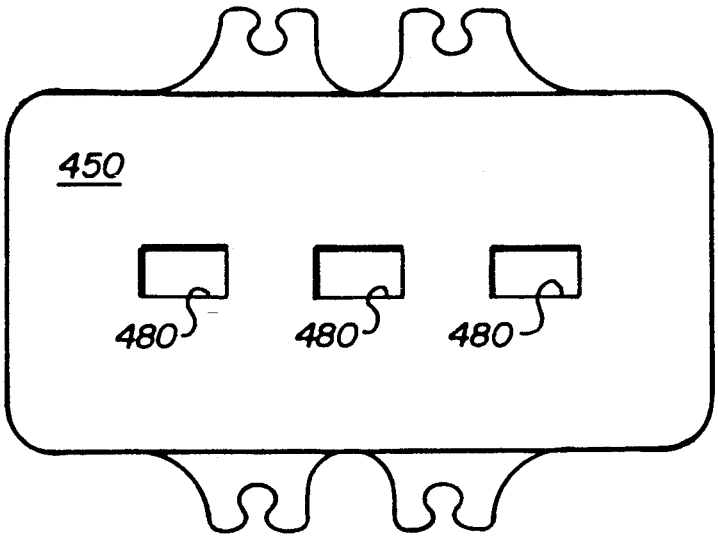
Fig. 17 PRIOR ART
FIG. 17 is a section view of a prior embodiment of an electrode of the prefocusing lens.

The novel electron gun of the present invention is to be contrasted to an electron gun of the type described in U.S. Pat. No. 4,764,704, referenced above. In that patent, a G4 electrode, similar to the G4 electrode 450 of the prefocusing, or second, lens shown in FIG. 17, has rectangularly-shaped apertures 480 therethrough. Specific dimensions of a computer model of an embodiment of that prior electron gun are presented in TABLE II. That embodiment has the electrical configuration shown in FIG. 2 herein, and is similar in construction to the electron gun shown in FIG. 4 herein, with similar gun elements being identified with corresponding numbers, prefixed by the number "4".

TABLE II

| | inches | mm |
|---|---|---|
| K-G1 spacing | 0.003 | 0.08 |
| Thickness of G1 electrode 444 | 0.004 | 0.10 |
| Thickness of G2 electrode 446 | 0.028 | 0.71 |
| G1 and G1 aperture diameters | 0.025 | 0.64 |
| G1 to G2 spacing | 0.008 | 0.20 |
| G2 to G3 spacing | 0.030 | 0.76 |
| Thickness of G3 bottom plate 468 | 0.010 | 0.25 |
| Diameter of G3 aperture 470, center | 0.045 | 1.14 |
| Diameter of G3 apertures 470, outer | 0.052 | 1.32 |
| Diameter of G3 apertures 478 | 0.148 | 3.76 |
| Length of G3 electrode 448 | 0.200 | 5.08 |
| G3 to G4 spacing | 0.500 | 1.27 |
| Thickness of G4 electrode 450 | 0.025 | 0.64 |
| Dimensions of G4 electrode apertures 480 | 0.158 V × 0.172 H | 4.01 V × 4.37 H |
| G4 to G5 spacing | 0.050 | 1.27 |
| Length of G5 electrode* 452–454 | 0.830 | 21.08 |
| Diameter of apertures 482 | 0.158 | 4.01 |
| Diameter of aperture 494 (center) | 0.160 | 4.06 |
| Diameter of apertures 494 (outer) | 0.180 | 4.57 |
| Horizontal width of recess 492 | 0.755 | 19.18 |
| Vertical height of recess 492 | 0.326 | 8.28 |
| Depth of recess 492 | 0.115 | 2.29 |
| Aperture-to-aperture spacing K to G5 bottom** | 0.260 | 6.60 |
| G5 to G6 spacing | 0.050 | 1.27 |
| Length of G6 electrode | 0.150 | 3.81 |
| Horizontal width of opening 400 | 0.742 | 18.85 |
| Maximum height of opening 400 | 0.295 | 7.49 |
| Minimum height of opening 400 | 0.289 | 7.34 |
| Depth of opening 400 | 0.135 | 3.43 |
| Diameter of aperture 404 (center) | 0.160 | 4.06 |
| Diameter of apertures 404 (outer) | 0.180 | 4.57 |
| Aperture-to-aperture spacing G5 top/G6 | 0.245 | 6.22 |
| Length of G3 extrusions 479 | 0.045 | 1.14 |
| Length of G5 extrusions 483 | 0.045 | 1.14 |
| Length of G5 extrusions 495 | 0.034 | 0.86 |
| Length of G6 extrusions 405 | 0.045 | 1.14 |

*unitized electrode, no multipole lens

**the aperture-to-aperture spacing of the G3 bottom apertures 470 is increased to 0.2635 inch (6.69 mm) to eliminate any displacement of the outer electron beams with changes in the focus voltage.

Figure 18:
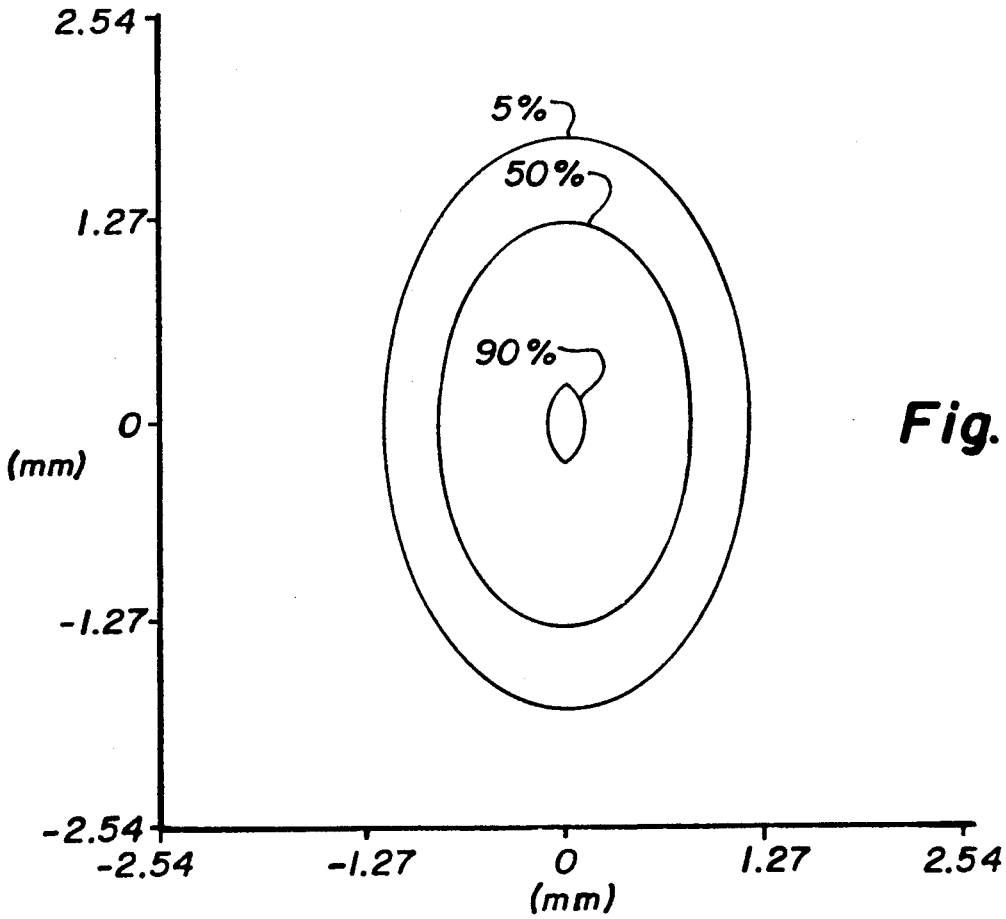
FIG. 18 is a graph of the beam current density contour at the center of the screen for an electron gun using the prior prefocusing lens electrode of FIG. 17.

In the prior electron gun described in TABLE II, the cathode operates at a drive voltage of about 103.2 V, the G1 electrode is at ground potential, the G2 and G4 are electrically interconnected and operate within the range of 300 V to 1000 V, the G3 and G5 electrodes also are interconnected and operate at about 6600 V, and the G6 electrode operates at an anode potential of about 25 kV. The prefocusing lens, L2, of the prior electron gun, with the rectangular apertures 480 formed through the substantially flat G4 electrode 450, provides a horizontally-elongated electron beam (not shown) into the main focusing lens, L3. A computer simulation of the resultant vertically-elongated beam spot at the center of the screen is graphically shown in FIG. 18. The beam size at 5% peak current density is about 2.30 mm×3.49 mm (H×V) at the previously described operating parameters.

CONCLUSION

The performance of the present prefocusing lens, L2, of embodiments 1 through 4, as measured by the resultant electron beam spot size on the screen, is comparable to that of the prior electron gun described in U.S. Pat. No. 4,764,704, which utilizes a prefocusing lens having rectangularly-shaped apertures in the G4 electrode thereof. A comparison of results is contained in TABLE III.

TABLE III

| EMBODIMENT | Beam Spot Size on Screen Horizontal (mm) | Vertical (mm) |
|---|---|---|
| 1 | 2.50 | 4.20 |
| 2 | 2.26 | 3.68 |
| 3 | 1.94 | 3.44 |
| 4 | 1.96 | 3.49 |
| Prior | 2.30 | 3.49 |

The four embodiments of the present electron gun structure provide ease of manufacturing, because the use of circular apertures throughout the electron gun reduces the misalignment problems posed by the rectangularly-shaped G4 apertures of the prior gun. Additionally, the prior gun requires a slight increase in the G3 aperture-to-aperture spacing (from 6.60 mm to 6.69 mm) to eliminate the misconvergence of the outer electron beams with changes in focus voltage. The present invention achieves comparable performance by controlling either the horizontal width of the race-track-shaped recesses within the prefocusing lens, L2, in embodiments 1 and 3, or the slot-to-slot spacing of the rectangular slots formed within prefocusing lens, L2, in embodiments 2 and 4. In each of the four embodiments, the aperture-to-aperture spacing from the cathode 42 to the bottom of the G5 electrode 52 is maintained at a constant value of 6.60 mm, thereby simplifying the assembly and alignment of the gun components.

What is claimed is:

1. In a color cathode-ray tube including an envelope having therein an inline electron gun for generating and directing three inline electron beams, including a center beam and two outer beams, along initially coplanar beam paths toward and screen on an interior portion of said envelope, said gun having six electrodes forming three electron lenses including a beam-forming lens, a prefocusing lens and a main focusing lens, the improvement wherein said prefocusing lens includes four active surfaces, at least one of which has a recess formed therein, said active surfaces produce quadrupole fields which form an astigmatic prefocusing lens, said recess provides a preconverging action on said outer electron beams, three circular apertures being provided within said recess.

2. The tube as described in claim 1 wherein said recess is configured to minimize the sensitivity of said gun to variations in operating potentials.

3. In a color cathode-ray tube including an envelope having therein an inline electron gun for generating and directing three inline electron beams, including a center beam and two outer beams, along initially coplanar beam paths toward and screen on an interior portion of said envelope, said gun having six electrodes forming three electron lenses including a beam-forming lens, a prefocusing lens and a main focusing lens, the improvement wherein said prefocusing lens includes four active surfaces on three adjacent electrodes, at least two of said surfaces having substantial identical recesses formed therein, said active surfaces produce quadrupole fields which form an astigmatic prefocusing lens that provides a horizontally-elongated electron beam to said main focusing lens, said recesses provide a preconverging action on said outer electron beams, each of said adjacent electrodes having circular apertures therethrough said apertures being aligned along said beam paths.

4. The tube as described in claim 3 wherein said recesses are configured to minimize the sensitivity of said gun to variations in operating potentials.

5. In a color cathode-ray tube including an envelope having therein an inline electron gun for generating and directing three inline electron beams along initially coplanar beam paths toward a screen on an interior portion of said envelope, said gun including a plurality of longitudinally spaced electrodes which form a first lens, a prefocusing lens and a main focusing lens for said electron beams, said first lens comprising a beam-forming region including a first electrode, a second electrode and a first portion of a third electrode for providing substantially symmetrically-shaped beams to said prefocusing lens comprising a second portion of said third electrode, a fourth electrode and a first portion of a fifth electrode, said prefocusing lens providing asymmetrically-shaped beams to said main focusing lens comprising of a second portion of said fifth electrode and a sixth electrode, said main focusing lens being a low aberration lens, wherein the improvement comprises, said prefocusing lens including four active surfaces with separate inline circular apertures therethrough, said fourth electrode having substantially identical asymmetric beam-focusing recesses formed in the oppositely disposed active surfaces thereof, said apertures being disposed within said recesses.

6. The tube as described in claim 5 wherein a single recess is formed in each active surface of said fourth electrode.

7. The tube as described in claim 5 wherein three separate, substantially rectangular recesses comprising two outer recesses and a center recess are formed in each active surface of said fourth electrode.

8. The tube as described in claim 7 wherein each of said outer recesses having an outer aperture therethrough said outer recesses being displaced outwardly relative to said outer apertures.

9. The tube as described in claim 5, wherein each of said circular apertures of said first lens and said prefocusing lens being coaxially aligned along said beam paths.

10. In a color cathode-ray tube including an envelope having therein an inline electron gun for generating and directing three inline beams along initially coplanar beam paths toward a screen on an interior portion of said envelope, said gun including six longitudinally spaced electrodes each having three inline circular apertures therethrough, said electrodes forming a first lens, a prefocusing lens and a main focusing lens for said electron beams, said first lens comprising a beam-forming region including a first electrode, a second electrode and a first portion of a third electrode for providing substantially symmetrically-shaped beams to said prefocusing lens comprising a second portion of said third electrode, a fourth electrode and a first portion of a fifth electrode, said prefocusing lens providing asymmetrically-shaped beams to said main focusing lens consisting of a second portion of said fifth electrode and a sixth electrode, said main focusing lens being a low aberration lens, wherein the improvement comprises, said prefocusing lens including four active surfaces, said second portion of said third electrode and said first portion of said fifth electrode having substantially identical, asymmetric beam-focusing recesses formed in the active surfaces thereof, said circular apertures being formed within said recesses.

11. The tube as described in claim 10 wherein a single recess is formed in said second portion of said third electrode and said first portion of said fifth electrode.

12. The tube as described in claim 10 wherein three separate, substantially rectangular recesses comprising two outer recesses and a center recess are formed in said active surfaces of said second portion of said third electrode and of said first portion of said fifth electrode.

13. The tube as described in claim 12 wherein each of said outer recesses having one of said circular apertures therethrough, said recesses being displaced outwardly relative to said circular apertures.

14. The tube as described in claim 10 wherein each of said circular apertures in each of said electrodes of said first lens and said prefocusing lens being coaxially aligned along said beam paths.

* * * * *

UNITED STATES PATENT AND TRADEMARK OFFICE

CERTIFICATE OF CORRECTION

PATENT NO. : 5,066,887

DATED : Nov. 19, 1991

INVENTOR(S) : David A. New

It is certified that error appears in the above-identified patent and that said Letters Patent is hereby corrected as shown below:

Col. 1, line 58, before "electron gun" add --a novel--.

Col. 6, line 8, change "produce" to --produces--.

Col. 6, lines 27 - 28, change "dimension" to --dimensions--.

Col. 6, line 29, after "recesses" add --,--.

Col. 7, line 16, after "(0.64mm)" add --,--.

Col. 7, line 23, change "Each" to --Also, each--.

Col. 7, line 32, change "dimensional" to --dimensioned--.

UNITED STATES PATENT AND TRADEMARK OFFICE

CERTIFICATE OF CORRECTION

PATENT NO. : 5,066,887

DATED : Nov. 19, 1991

INVENTOR(S) : David A. New

It is certified that error appears in the above-identified patent and that said Letters Patent is hereby corrected as shown below:

Col. 7, line 64, change "race-track shaped" to --race-track-shaped--.

Col. 8, line 1, change "race track" to --race-track--.

Col. 8, line 51, delete "80".

Col. 10, line 59, change "and" to --a--.

Signed and Sealed this

Twenty-third Day of March, 1993

*Attest:*

STEPHEN G. KUNIN

*Attesting Officer*

*Acting Commissioner of Patents and Trademarks*